US006062554A

United States Patent [19]

Leonard

[11] Patent Number: 6,062,554

[45] Date of Patent: May 16, 2000

[54] DUAL CLAMPING APPARATUS

[76] Inventor: Nelson F. Leonard, Morgan St. Extension, Bennington, Vt. 05201

[21] Appl. No.: 09/186,101

[22] Filed: Nov. 5, 1998

[51] Int. Cl.[7] ..... B25B 5/10

[52] U.S. Cl. ..... 269/153; 269/242; 269/243; 269/268; 269/902

[58] Field of Search ..... 403/43–45; 269/242, 269/243, 152, 153, 902, 268

[56] References Cited

U.S. PATENT DOCUMENTS

| | | | |
|---|---|---|---|
| 2,061,217 | 11/1936 | Watcher . | |
| 3,493,223 | 2/1970 | Galbarini et al. . | |
| 3,861,664 | 1/1975 | Durkee | 269/153 |
| 3,957,261 | 5/1976 | Hefel | 269/243 |
| 4,027,886 | 6/1977 | Ruggiero | 269/242 |
| 4,046,364 | 9/1977 | Cooper et al. . | |
| 5,064,178 | 11/1991 | Nimtz . | |
| 5,108,080 | 4/1992 | James . | |
| 5,181,702 | 1/1993 | Pettigrew . | |
| 5,568,915 | 10/1996 | Raymond . | |
| 5,683,077 | 11/1997 | Fink et al. . | |
| 5,735,513 | 4/1998 | Toffolon | 269/153 |

*Primary Examiner*—Robert C. Watson
*Attorney, Agent, or Firm*—John J. Welch, Jr., Esq.

[57] ABSTRACT

The instant invention is a dual clamping apparatus consisting of a three sided clampstand component, one left handed screw bolt and one right handed screw bolts, a bi-threaded barrel component held by the screw bolts insertable each through hexagonally shaped holes in the lateral sides of the clampstand, the barrel component having a horizontally inclined through hole centered therein from side to side, half of which is marked by the presence of right handed threading and half of which is marked by the presence of left hand threading for receipt of the screw bolts as well as having a plurality of closed lever holes within its outer surface for receipt of a lever to turn the barrel component through an angle causing movement outward or inward as the case may be of the inserted screw bolts and further with each screw bolt having a closed, threaded hole in the head of each for receipt of an extension screw component fitted with a threaded extension screw nut component with a pair of tapped holes in the base of the clampstand and an optional lever component.

6 Claims, 4 Drawing Sheets

DUAL CLAMPING APPARATUS

CROSS REFERENCE TO PRIOR OR PARENT APPLICATION

There are no prior or parent applications.

FEDERALLY SPONSORED RESEARCH AND DEVELOPMENT

There is no federally sponsored research or development.

BACKGROUND OF THE INVENTION

1. Field of the Invention

The instant invention relates to those devices utilized for holding metalwork to be machined fast in place.

2. Possibly Related Art

The art tabulated in the Informational Disclosure Statement submitted herewith resembles but does not anticipate the instant invention.

SUMMARY OF THE INVENTION

1. A Brief Description of the Invention

The instant invention consists of a clampstand component through each lateral side of which are hexagonally shaped through holes, one such hole per side. Through one such hole there is insertable a right handed screw bolt. Through the other, there is insertable a left handed screw bolt. The screw bolts fit into a bi-threaded barrel component located between the two lateral sides of the clampstand. Half of a centered horizontally inclined through hole in the bi-threaded barrel component is marked by the presence of right handed threading, the other half by the presence of left handed threading. The exterior portion of the bi-threaded barrel component is characterized by the presence of a plurality of bored, closed lever holes into which a removable lever component can be inserted in order to turn the bi-threaded barrel component through an angle. Each screw bolt has a threaded closed hole through the head of each for receipt of an extension screw component about which an extension screw nut component is also threaded.

2. Objects of the Invention

A difficulty far too often encountered by machinists seeking to work on metal pieces is the problem of having to clamp them to a work table with clamps that are either too high or too low and in constant need of adjustment. The instant invention serves to completely alleviate this difficulty whereas it serves to obviate completely any need of any such adjustment. Moreover, the instant invention serves to obviate completely the need to mill over the top of a piece, then drop down, etc., a process that serves to invite uneven milling of multiple pieces, if multiple pieces are to be machined contemporaneously over time. Furthermore, the instant invention serves to permit machining of a far greater number of similar metal pieces at any one time than do any related clamping devices. The instant invention permits much more work to be done and without error than do other such clamping devices.

For the foregoing reasons, respectfully submitted, the instant invention is not only new, useful and unique but is, indeed, virtually revolutionary in respect of the art involving such devices.

A DESCRIPTION OF THE DRAWINGS

Figure 1:
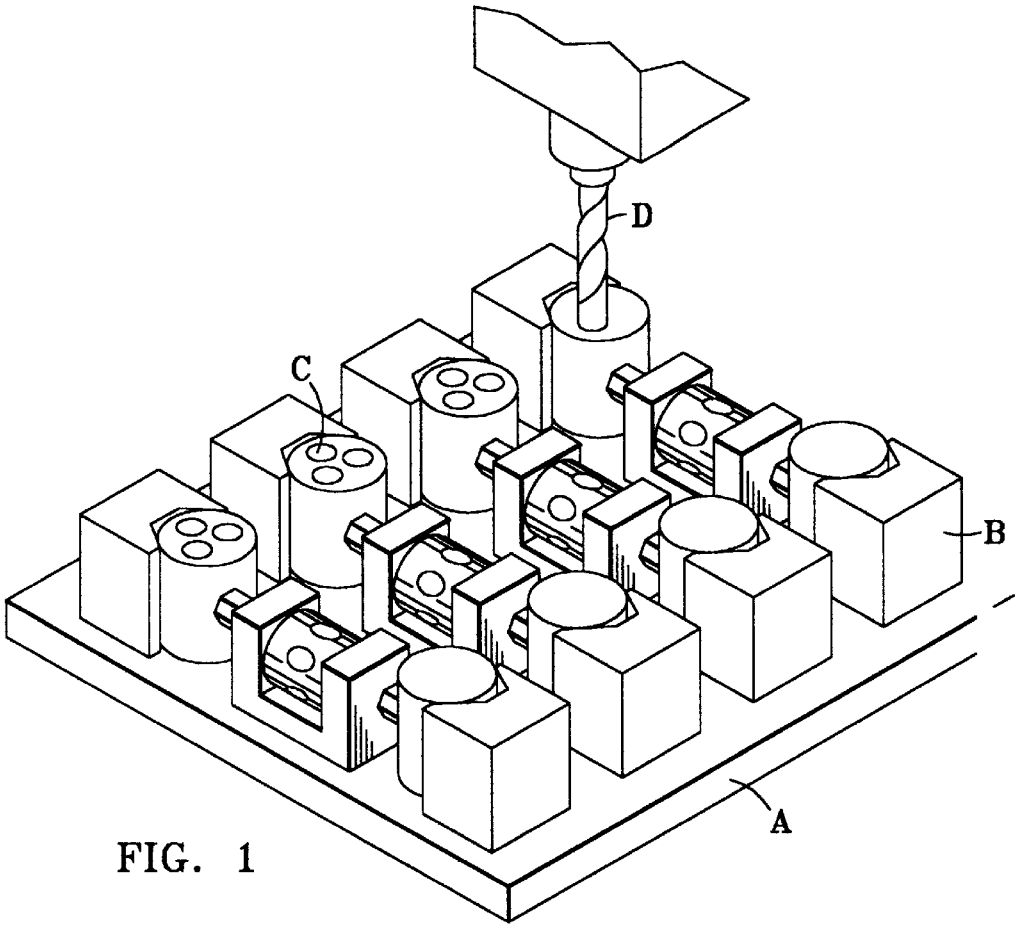

1. FIG. 1 is a perspective view of multiple units of the intact instant invention holding work to be machined in place.

Figure 2:
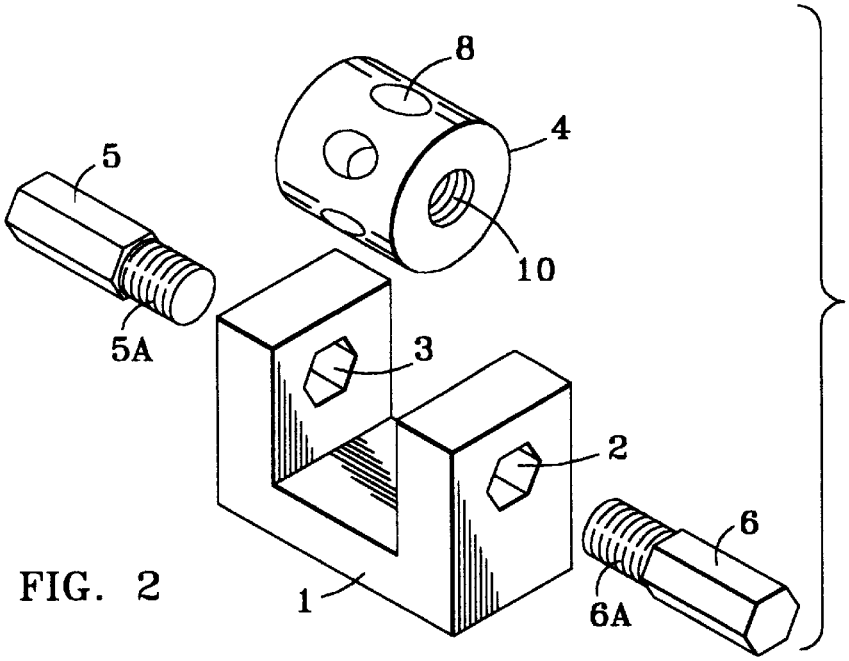

2. FIG. 2 is an exploded view of the instant invention.

Figure 3:
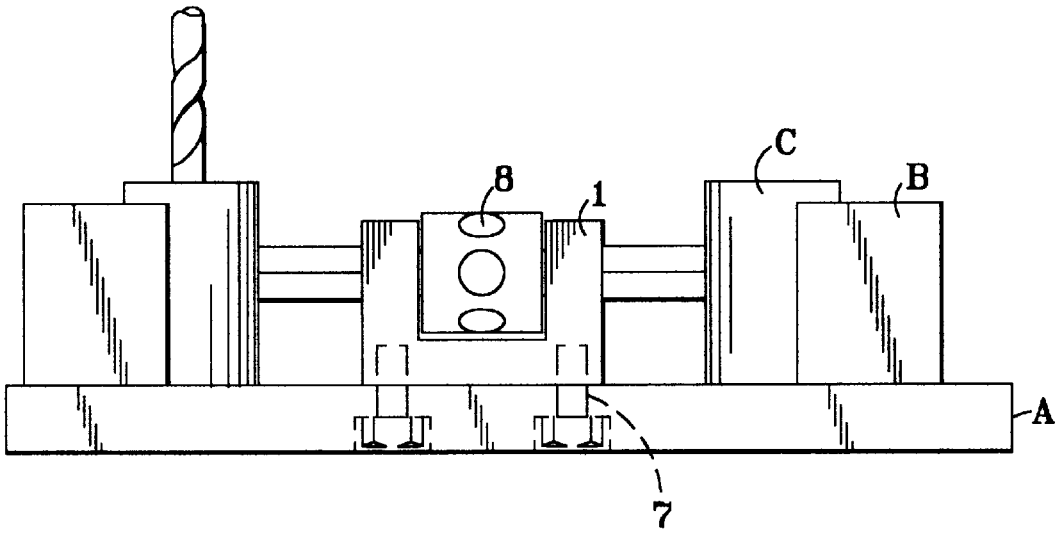

3. FIG. 3 is a frontal plan view of the instant invention shown holding work in place.

Figure 4:
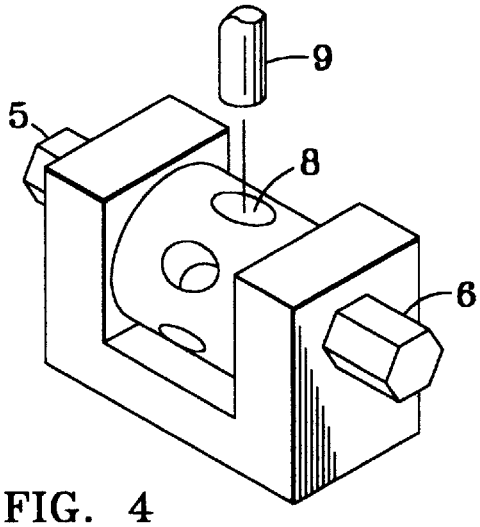

4. FIG. 4 is an isolated view of the intact instant invention.

Figure 5:
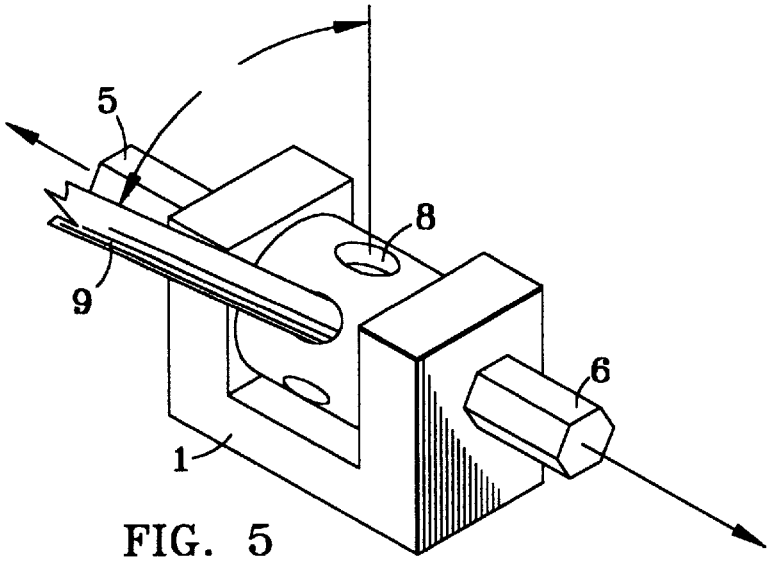

5. FIG. 5 is an isolated view of the intact instant invention illustrating how a turning of the bi-threaded barrel component of the instant invention through an angle causes screw bolts to move outwardly.

Figure 6:
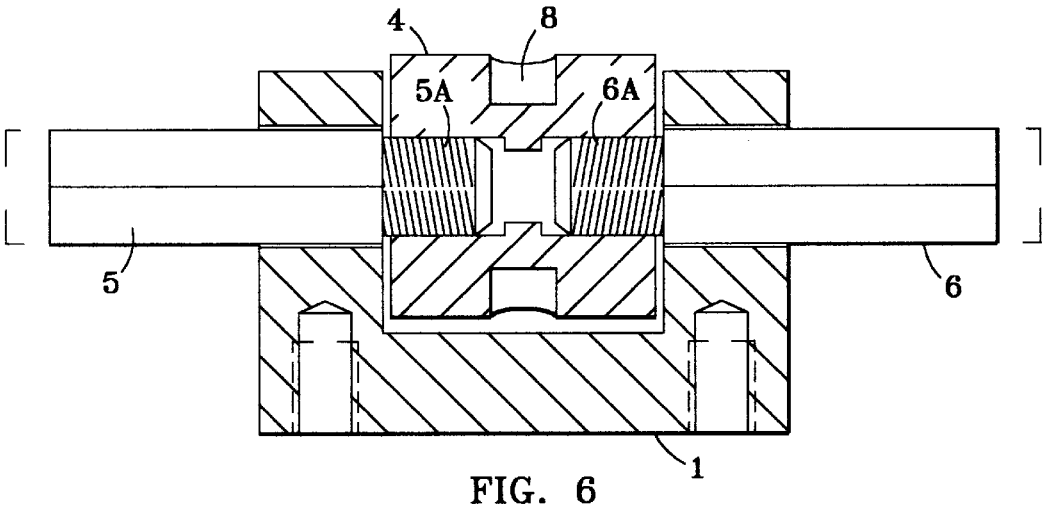

6. FIG. 6 is a frontal cross-sectional view of the clampstand and bi-threaded barrel components of the instant invention and threading within the barrel components of the instant invention.

Figure 7:
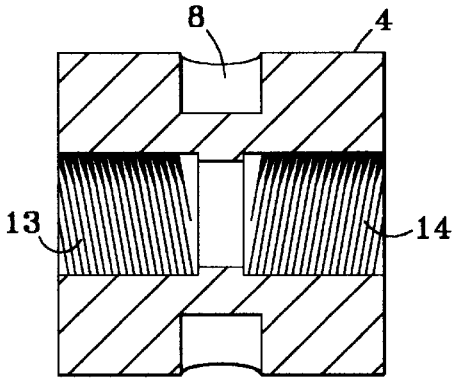

7. FIG. 7 is an isolated frontal cross-sectional view of the bi-threaded barrel component of the instant invention.

Figure 8:
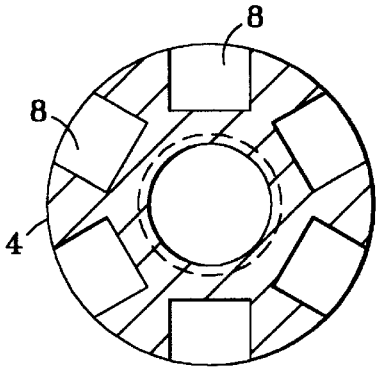

8. FIG. 8 is an isolated lateral cross-sectional view of the bi-threaded barrel component of the instant invention.

Figure 9:
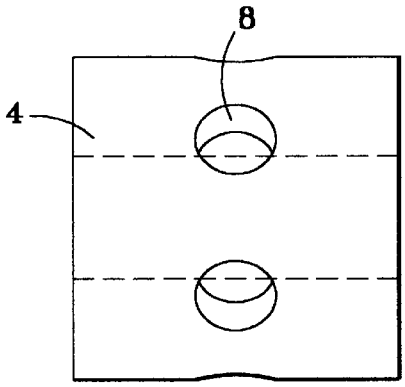

9. FIG. 9 is an isolated frontal plan view of the bi-threaded barrel component of the instant invention.

Figure 10:
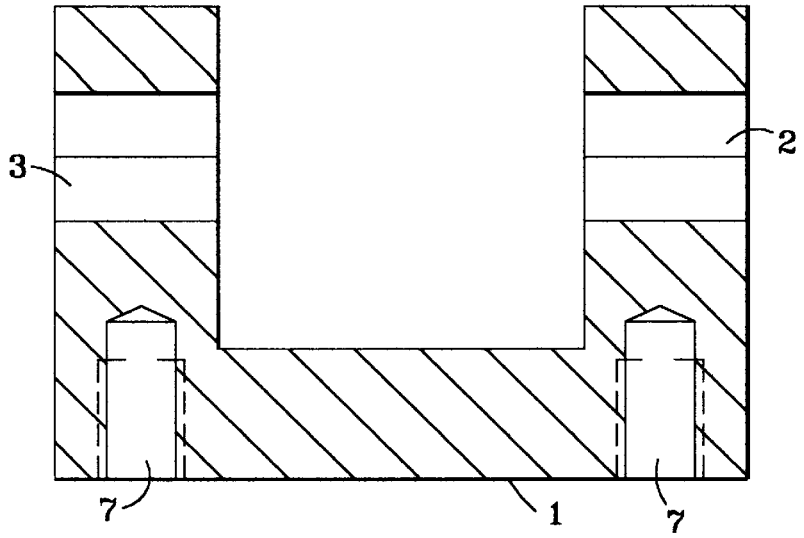

10. FIG. 10 is an isolated frontal cross-sectional view of the clampstand component of the instant invention.

Figure 11:
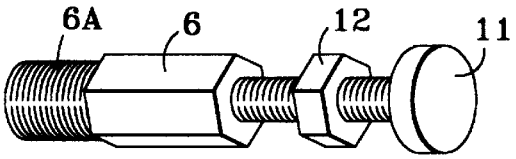

11. FIG. 11 is an isolated perspective view of a screw bolt component of the instant invention into which an extension screw component holding extension screw nut component has been threaded.

Figure 12:
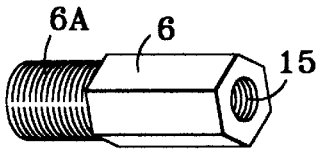

12. FIG. 12 is an isolated perspective view of a screw bolt component of the instant invention showing a threaded closed hole into which an extension screw component can be threaded.

Figure 13:
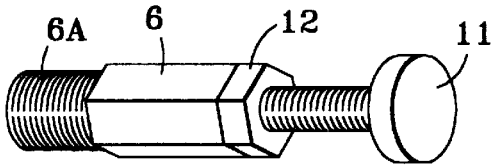

13. FIG. 13 is an isolated perspective view of what is shown in FIG. 11 except for a turning of the extension screw nut component down to the locus of the head of the screw bolt component.

Figure 14:
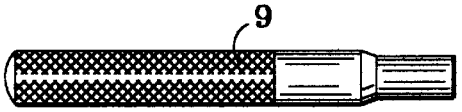

14. FIG. 14 is an isolated perspective view of the lever component of the instant invention.

A DETAILED DESCRIPTION OF THE INVENTION

In FIG. 1, there is to be noted, a work bench A fitted to which there are a series of work anchors B serving to hold work C being altered by virtue of the operation of a drill D. A plurality of units of the intact instant invention are therein seen as well. As was earlier noted, the instant invention permits clamping of units of work C in such a manner as to greatly enhance machining efficiency and to likewise markedly save time. One simple initial adjustment applied to all of the units of the instant invention being utilized at any one time is all that is necessary in order to propitiously hold work fast for an efficient machining of the same as contrasted with the need for repeated multiple adjustments of clamps during the machining process as is the case with respects to other types of clamping devices. Moreover, with resort to use of the instant invention, there is no need to mill over the top of a clamp then drop it down during the course of a machining undertaking as is invariably the case with such other types of clamping devices such that therefore, not only is time saved but also a propensity for erroneous uneven milling is likewise averted. In FIG. 2, a three sided clampstand component I is seen along with a first hexagonally shaped through hole 2 in a first lateral side of clampstand component 1 and a second hexagonally shaped through hole 3 in a second lateral side thereof Holes 2 and 3 serve to receive left hand screw bolt 6 counterclockwise turnable with respect to screwing inwardly and right hand screw bolt 5 clockwise turnable with respect to screwing inwardly, respectively. Bi-threaded barrel component 4 fits between the two lateral sides of clampstand component 1 upon assembly of the invention. FIGS. 3 and 10 depict tapped anchoring holes 7 which are amenable to receiving screws to hold the invention fast to a top surface of work bench A. A plurality of closed lever holes 8 in the top rounded surface of barrel component 4 serve for receipt of a turning lever 9 as seen in FIG. 4 which is utilized to turn barrel component 4 through an angle as depicted in FIG. 5. FIGS. 8 and 9 illustrate the loci of lever holes 8 in barrel component 4 as well. FIG. 7 depicts the threading found in a side to side horizontally inclined centered through hole 10 in barrel component 4. Right handed screw bolt threading 13 encompasses one half of centered through hole 10 and left handed screw bolt threading 14 encompasses the other half of centered through hole 10. FIG. 6 illustrates placement of left hand screw bolt 6 and right hand screw bolt 5 into centered through hole 10 and receipt of threading 6A and 5A of each respectively by left handed screw bolt threading 14 and right handed screw bolt threading 13 seen as noted above in FIG. 7. When an intact invention is placed between two pieces of work C anchored each by a work anchor B in a work bench A, a turning of barrel component 4 through an angle with a lever 9 inserted in a hole 8 causes each screw bolt 5 and 6 to be pushed outwardly to press the work C fast against a work anchor B. A reverse turning of barrel component 4 causes screw bolts 5 and 6 to be pulled inwardly to release the work C from work anchor B. The purpose of hexagonally shaped through holes 2 and 3 is to prevent the hexagonally shaped heads of screw bolts 5 and 6 and in turn screw bolts 5 and 6 from turning or back or forth or up and down as barrel component 4 is so rotated through an angle. Such an inability to turn or move other than in or out ensures against damage to work C or less than optimal holding of work C as against work anchor B. FIG. 12 illustrates closed threaded hole 15 within the hexagonally shaped head of one of the two screw bolts 5 or 6 of the invention. Threaded hole 15 serves to receive extension screw component 11 as shown in FIG. 13. A threaded extension screw nut component 12 shown in FIG. 11 about extension screw 11 can be tightened down onto the hexagonally shaped head of a screw bolt 5 or 6. The purpose of extension screw component 11 and threaded extension screw nut component 12 is to facilitate the holding of work as against work anchors B on work benches A when due to the breadth of the span between work anchors B or the size of the work C, there needs to be additional horizontally inclined holding force length in excess of that provided merely by the fully outwardly extended horizontally shaped heads of screw bolts 5 and 6 in order to hold work C fast against work anchors B. FIG. 14 illustrates a typical lever component 9.

In closing respectfully submitted, in view of the foregoing, the instant invention is indeed new, useful and unique within the field of clamping devices for holding fast, work being machined.

What is claimed is:

1. A Dual Clamping Apparatus, comprising:

a. a three sided clampstand component;

b. a first hexagonally shaped through hole in a first lateral side of said three sided clampstand component;

c. a second hexagonally shaped through hole in a second lateral side of said three sided clampstand component;

d. a left handed screw bolt component with hexagonally shaped head insertable into said first hexagonally shaped through hole;

e. a right handed screw bolt component with hexagonally shaped head insertable into said second hexagonally shaped through hole;

f. a bi-threaded barrel component;

g. a plurality of closed lever receiving holes bored into an outer rounded surface of said bi-threaded barrel component;

h. a side to side horizontally inclined centered through hole in said bi-threaded barrel component;

i. said centered through hole being characterized by the presence of right handed screw threading over a first half of a breadth of said centered through hole;

j. said centered through hole being characterized by the presence of left handed screw threading over a second half of a breadth of said centered through hole;

k. said right handed screw bolt component being threadable into said first half of a breadth of said centered through hole, and;

l. said left handed screw bolt component being threadable into said second half of a breadth of said centered through hole.

2. A Dual Clamping Apparatus, comprising:

a. a three sided clampstand component;

b. a first hexagonally shaped through hole in a first lateral side of said three sided clampstand component;

c. a second hexagonally shaped through hole in a second lateral side of said three sided clampstand component;

d. a left handed screw bolt component with hexagonally shaped head insertable into said first hexagonally shaped through hole;

e. a right handed screw bolt component with hexagonally shaped head insertable into said second hexagonally shaped through hole;

f. a bi-threaded barrel component;

g. a plurality of closed lever receiving holes bored into an outer rounded surface of said bi-threaded barrel component;

h. a side to side horizontally inclined centered through hole in said bi-threaded barrel component;

i. said centered through hole being characterized by the presence of right handed screw threading over a first half of a breadth of said centered through hole;

j. said centered through hole being characterized by the presence of left handed screw threading over a second half of a breadth of said centered through hole;

k. said right handed screw bolt component being threadable into said first half of a breadth of said centered through hole;

l. said left handed screw bolt component being threadable into said second half of a breadth of said centered through hole, and;

m. a pair of equivalent closed anchoring holes in a bottom side of said three sided clampstand component.

3. A Dual Clamping Apparatus, comprising:

a. a three sided clampstand component;

b. a first hexagonally shaped through hole in a first lateral side of said three sided clampstand component;

c. a second hexagonally shaped through hole in a second lateral side of said three sided clampstand component;

d. a left handed screw bolt component with hexagonally shaped head insertable into said first hexagonally shaped through hole;

c. a right handed screw bolt component with hexagonally shaped head insertable into said second hexagonally shaped through hole;

f. a bi-threaded barrel component;

g. a plurality of closed lever receiving holes bored into an outer rounded surface of said bi-threaded barrel component;

h. a side to side horizontally inclined centered through hole in said bi-threaded barrel component;

i. said centered through hole being characterized by the presence of right handed screw threading over a first half of a breadth of said centered through hole;

j. said centered through hole being characterized by the presence of left handed screw threading over a second half of a breadth of said centered through hole;

k. said right handed screw bolt component being threadable into said first half of a breadth of said centered through hole;

l. said left handed screw bolt component being threadable into said second half of a breadth of said centered through hole;

m. a closed threaded hole in said hexagonally shaped head of said right handed screw bolt;

n. a closed threaded hole in said hexagonally shaped head of said left handed screw bolt;

o. a first extension screw component receivable by said closed threaded hole in said right handed screw bolt, and;

p. a second extension screw component receivable by said closed threaded hole in said left handed screw bolt.

4. A Dual Clamping Apparatus, comprising:

a. a three sided clampstand component;

b. a first hexagonally shaped through hole in a first lateral side of said three sided clampstand component;

c. a second hexagonally shaped through hole in a second lateral side of said three sided clampstand component;

d. a left handed screw bolt component with hexagonally shaped head insertable into said first hexagonally shaped through hole;

e. a right handed screw bolt component with hexagonally shaped head insertable into said second hexagonally shaped through hole;

f. a bi-threaded barrel component;

g. a plurality of closed lever receiving holes bored into an outer rounded surface of said bi-threaded barrel component;

h. a side to side horizontally inclined centered through hole in said bi-threaded barrel component;

i. said centered through hole being characterized by the presence of right handed screw threading over a first half of a breadth of said centered through hole;

j. said centered through hole being characterized by the presence of left handed screw threading over a second half of a breadth of said centered through hole;

k. said right handed screw bolt component being threadable into said first half of a breadth of said centered through hole;

l. said left handed screw bolt component being threadable into said second half of a breadth of said centered through hole;

m. a closed threaded hole in said hexagonally shaped head of said right handed screw bolt;

n. a closed threaded hole in said hexagonally shaped head of said left handed screw bolt;

o. a first extension screw component receivable by said closed threaded hole in said right handed screw bolt;

p. a second extension screw component receivable by said closed threaded hole in said left handed screw bolt;

q. a first threaded extension screw nut component threaded about said first extension screw component, and;

r. a second threaded extension screw nut component threaded about said second extension screw component.

5. The Dual Clamping Apparatus of claim 3 whereby a pair of equivalent closing anchoring holes are located in a bottom side of said three sided clampstand component.

6. The Dual Clamping Apparatus of claim 4 whereby a pair of equivalent closing anchoring holes are located in a bottom side of said three sided clampstand component.

* * * * *